US005375705A

United States Patent [19]

Chan

[11] Patent Number: 5,375,705

[45] Date of Patent: Dec. 27, 1994

[54] COMBINATION POCKET DISPLAY FOLDER

[76] Inventor: Michael L. F. Chan, 1407 Arch St., Berkeley, Calif. 94708

[21] Appl. No.: 240,275

[22] Filed: May 9, 1994

Related U.S. Application Data

[63] Continuation-in-part of Ser. No. 92,253, Jul. 14, 1993, Pat. No. 5,337,889.

[51] Int. Cl.[5] ..... B65D 85/18

[52] U.S. Cl. ..... 206/294; 206/278; 206/292; 229/87.15

[58] Field of Search ..... 206/49, 292, 294, 278, 206/486, 488, 489, 494; 229/87.15

[56] References Cited

U.S. PATENT DOCUMENTS

| | | | |
|---|---|---|---|
| 857,293 | 6/1907 | Meyers | 206/49 |
| 885,721 | 4/1908 | Cave | 229/87.15 |
| 1,018,905 | 2/1912 | Herman | 206/278 |
| 1,398,364 | 11/1921 | Davidson | 206/278 |
| 1,667,482 | 4/1928 | Lee | 229/87.15 |
| 1,668,572 | 5/1928 | Parmele | 206/292 |
| 1,673,144 | 6/1928 | George | 229/87.15 |
| 1,870,386 | 8/1932 | Sever | 206/494 |
| 2,783,880 | 3/1957 | Kayton et al. | 206/49 |
| 3,908,822 | 9/1975 | Giberstein | 206/278 |

*Primary Examiner*—David T. Fidei
*Attorney, Agent, or Firm*—Schneck & McHugh

[57] ABSTRACT

A package to display fabric items, such as scarves and handkerchiefs, or cards and note paper in combination with fabric items. The package is a folder that has two overlapping pockets with diagonally oriented openings which are in oblique facing relation to one another. The area bounded by the pockets defines a V-shaped bordered portion. The package is assembled by inserting the fabric item, or card and note paper in combination therewith, into both of the pockets wherein the fabric item is displayed within the V-shaped bordered portion. The front surface has at least one pocket with an aperture, and one end of the fabric item is fed therethrough. The folder is assembled from a single stiff paper blank containing a number of score lines along which it is folded. The assembled folder shape is maintained by interlocking panels thereby abrogating the use of adhesives.

3 Claims, 2 Drawing Sheets

COMBINATION POCKET DISPLAY FOLDER

CROSS REFERENCES TO RELATED APPLICATIONS

This is a continuation-in-part of patent application Ser. No. 08/092,253 filed Jul. 14, 1993, now U.S. Pat. No. 5,337,889.

TECHNICAL FIELD

The invention relates generally to display packaging for items such as fabric, or cards and note paper in combination with fabric and specifically, to a pocket display folder for arranging such items therein.

BACKGROUND ART

Decorative fabrics, such as scarves and handkerchiefs, are frequently displayed in retail establishments adjacent to other similar items which compete for the consumer's attention. Scarves are generally loosely displayed by being draped over a stand, thereby providing a consumer with both a visual and a tactile perception of them. Handkerchiefs, on the other hand, are generally wrapped in transparent packaging that precludes a consumer from obtaining a tactile perception of the package's contents.

Items having irregular patterns composed of similar colors on their surface, while pleasing to the eye on close inspection, sometimes fail to attract the consumer's attention when a large display of similar items is scanned. The human visual system is organized to respond to contrasting patterns in the visual field. For example, there are neurons in the visual cortex which only respond to lines at specific angles in an individual field. Irregularly shaped patterns thus have a tendency to fade into the visual background, like camouflage.

An additional problem arises with loosely displayed items when they are removed from a display stand. These items are often indiscriminately returned to the display stand after inspection by the consumer. This results in there being no apparent order to the display. Occasionally, damage to the items occurs from them being scattered about, e.g., on the floor. Packaging for handkerchiefs is often damaged by consumers requiring tactile perception of the package's contents. This also results in a display that looks in disarray. Often, the unpackaged handkerchiefs are damaged in the same manner as the scarves.

It is therefore an object of the present invention to provide an improved display package for scarves and other items manufactured from fabric which enhances the item's visibility and visual appeal.

It is a further object to provide an improved display package which protects the item from damage during handling and transfer and allows greater access to the product for the consumer's inspection.

SUMMARY OF INVENTION

Briefly, the present invention includes a display package for scarves or other items manufactured from fabric which enhances the visibility of the item in a retail environment by juxtapositioning the item with a uniformly colored triangular field. The field is located on the front surface of a rectangular display folder having a pair of partially overlapping pockets. The pockets have diagonally oriented openings which are in oblique facing relation to one another. The package is assembled by inserting the item into one or both of the pockets of the folder.

In the preferred embodiment, fabric having print on both sides is inserted in the rear pocket of the folder. The front surface of the folder has a hole. The fabric is displayed against a V-shaped field, and a portion is fed through the hole and configured to suggest a flower. In another embodiment, a card or other sheet material may be inserted into the pocket, behind the fabric, to both support it and enhance the packaging's aesthetic appeal. The fabric will be displayed in the manner mentioned above. In this arrangement, the card may be either plain or decorative.

In a preferred form, the folder is formed from a single blank of stiff paper or other flexible, formable material. The blank is rectangular in shape, with a length approximately four times its width. The blank contains a number of score lines along which it is folded. The folder is assembled without the use of adhesive and maintains its assembled shape through an interlocking relation of its panels.

An advantage of the display package of the present invention is enhanced visibility of the displayed item. Another advantage is that the display package protects the items from damage during handling and transport while allowing greater access to it.

FIGS. *2a* through *2f* are sequential plan views of a dual-pocket folder being assembled from a blank.

BEST MODE FOR CARRYING OUT THE INVENTION

Figure 1:
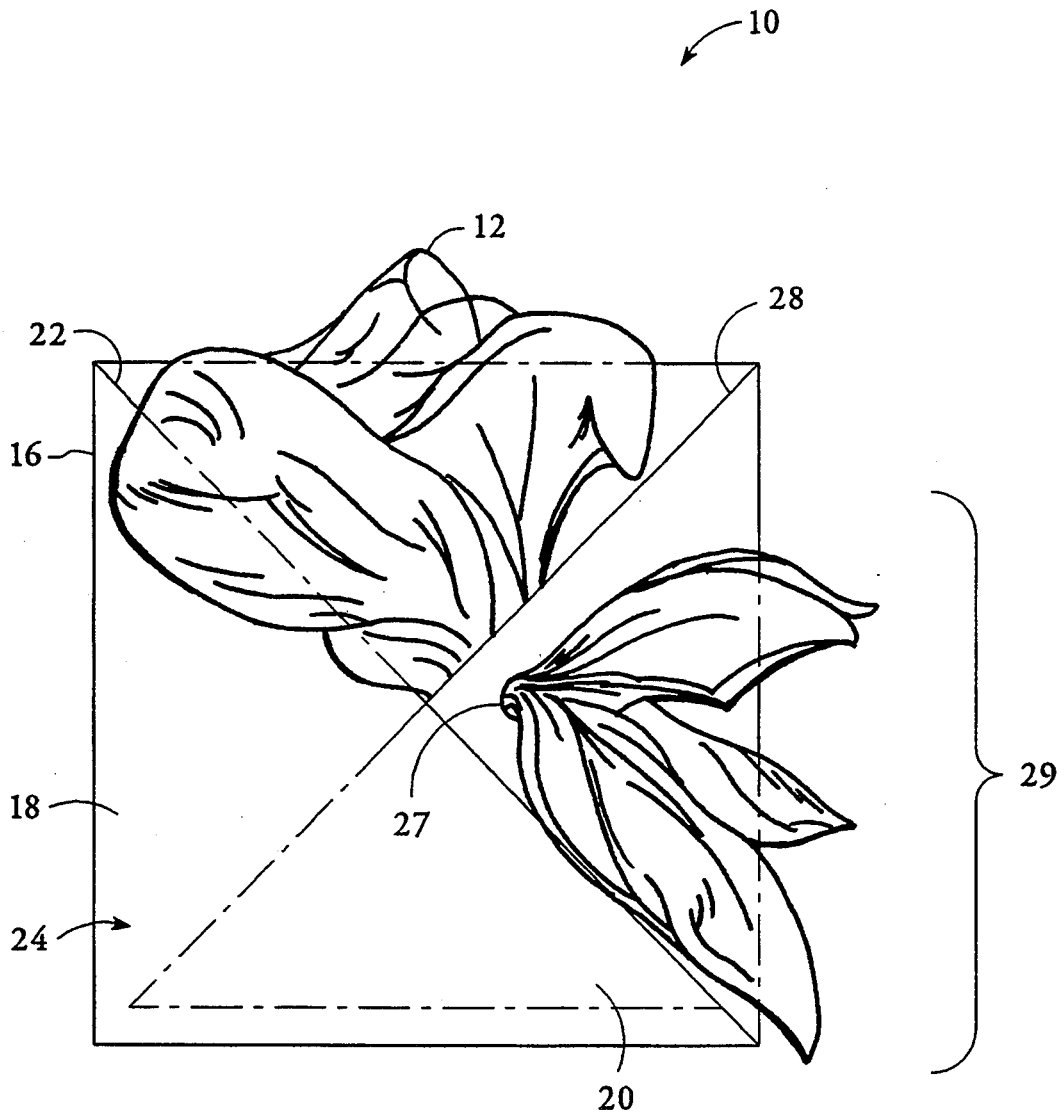
FIG. 1 is a front view of a display package which is designed in accordance with the present invention.
Figure 2A:
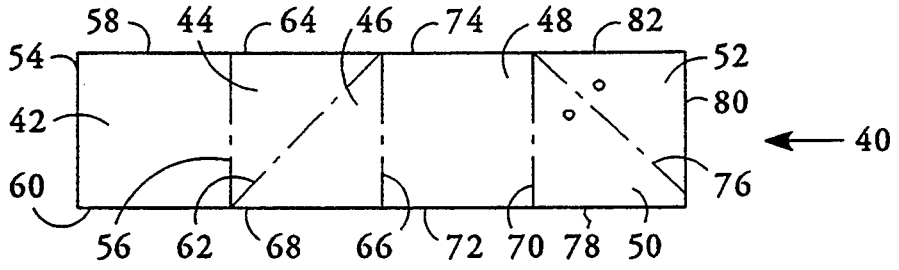
Figure 2B:
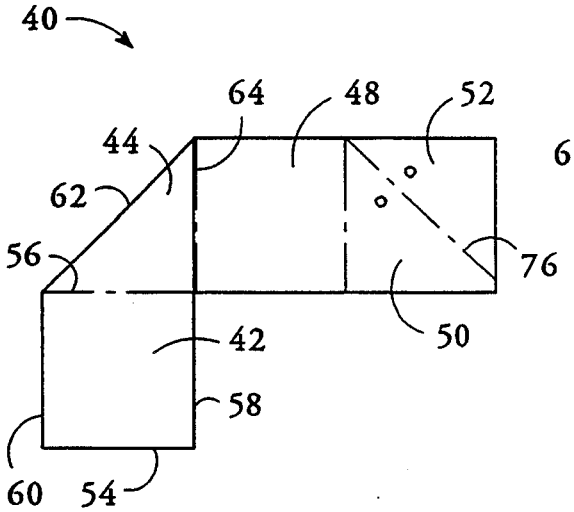
Figure 2C:
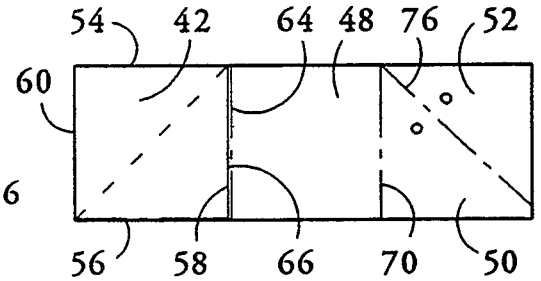
Figure 2D:
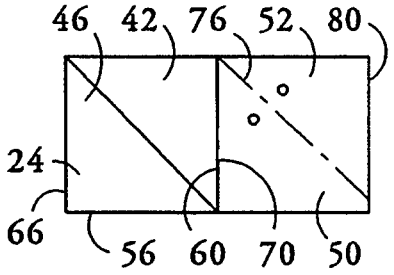
Figure 2E:
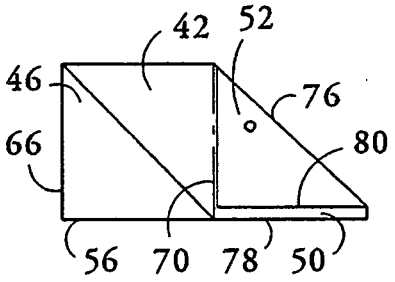
Figure 2F:
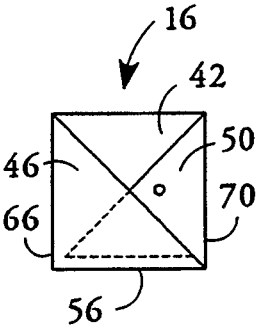

With reference to FIG. 1, shown therein is a display package 10 including a display item 12 and a display folder 16. Folder 16 has a pair of partially overlapping triangular-shaped pockets 18 and 20. Front pocket 18 has a diagonally oriented, upwardly facing opening 22 and an outside front surface 24. Rear pocket 20 has a diagonally oriented opening 28 with an aperture 27 proximate its center. Opening 28 is in oblique facing relation to front pocket opening 22.

Item 12 is a fabric having print on both sides with one end extending through aperture 27 to suggest a flower 29. Folder 16 is generally constructed of stiff paper material which has a uniform color complimentary to the print of item 12.

Display package 10 is assembled by inserting display item 12 into both the front pocket 18 and rear pocket 20 of folder 16. The visual contrast between the uniformly colored surface 24 and patterned display item 12 greatly enhances the visibility of display package 10.

Referring now to FIGS. *2a* through *2f*, folder 16 is preferably assembled from a stiff paper blank 40, which has two back sections, two front sections and two tab sections. Other flexible, formable materials such as cardboard or plastic may also be employed. The two back sections are inside and outside back panels 42 and 48; the front sections are inside and outside front panels 44 and 46; and the two tab sections are front and back tab panels 52 and 50. The terms front, back, top, bottom and side refer to each element's position in the final assembled folder as depicted in FIG. *2f*. Front and back tab panels 52 and 50 each have a pair of cutout holes 96 symmetrically located adjacent to the first diagonal score line 76 along a line perpendicular thereto. Inside back panel 42 is defined in the longitudinal direction by the separation between the parallel top edge 54 and bottom score line 56. Inside back panel 42 is defined in the lateral direction by first side at 58 and second side at 60 which connect edge 54 and line 56.

Inside front panel 44 is triangular in shape and extends from inside back panel 42 at bottom score line 56 to first diagonal score line 62, and is further defined by the third side at 64. The third side edge 64 is substantially equal to the length of first side edge 58.

Outside front panel 46 is triangular in shape and extends from inside front panel 44 at first diagonal score line 62 to first side score line 66, and is further defined by first bottom edge 68. It is preferred that first side score line 66 be parallel to first bottom score line 56. Outside panel 46 is substantially equal in area to inside front panel 44.

Outside back panel 48 is rectangular in shape and extends from outside front panel 46 at first side score line 66 to second side score line 70, and is further defined by second bottom edge 72 and second top edge 74. It is preferred that second side score line 70 be parallel to first side score line 66 and that second bottom edge 72 and second top edge 74 be slightly longer in length than first top edge 64 and bottom score line 56.

Front tab panel 50 is triangular in shape and extends from outside back panel 48 at second side score line 70 to second diagonal score line 76, and is further defined by third bottom edge 78. Front tab panel 50 is slightly smaller in area than front panels 44 and 46.

Back tab panel 52 is triangular in shape and extends from front tab panel 50 at second diagonal score lines 76, fourth bottom edge 80, and is further defined by fourth side edge 82. Back tab panel 52 is slightly smaller in area than front tab panel 50.

Referring now to FIG. *2b*, the first step in assembly is to fold the blank 40 along the first diagonal score line 62 placing inside front panel 44 adjacent to outside front panel 46 in coextensive overlapping relation such that second side 64 is adjacent to first score line 66. The direction in which the fold is made along score line 62 determines which side the front pocket opening will face, once the folder is assembled.

Referring now to FIG. *2c*, inside back panel 42 is folded toward inside front panel 44 along bottom score line 56 placing first side at 58 adjacent to second side at 64 and first side score line 66. Inside back panel 42 is in place adjacent to outside back panel 48 by folding along first side score line 66. As illustrated in FIG. *2d*, second side at 60 is adjacent to second side score line 70 and outside front surface 24 of outside front panel 46.

Assembly is completed by folding back tab panel 52 toward front tab panel 50 along second diagonal score line 76 which results in cutout holes 96 being coextensively aligned as illustrated in FIG. *2e*. Front and back tab panels 50 and 52 are then inserted between inside front panel 44, not shown, and inside back panel 52 by folding along second side score line 70, as illustrated in FIGS. *2e* through *2f*. In assembled folder 16, third bottom edge 78 and fourth bottom edge 80 are adjacent to bottom score line 56. The interlocking relation of tab panels 50 and 52 with inside front panel 44 and inside back panel 42 maintains the folder 16 in its assembled configuration without adhesives.

A second preferred embodiment, not shown, includes having a decorative card inserted behind the fabric with the fabric inserted into the folder as described above. In this embodiment the decorative card serves to both support item 12 and enhance the package's 10 aesthetic appeal.

I claim:

1. A display package comprising, a fabric item, printed on opposite sides, having the approximate size of a lady's scarf, a rectangular folder having a uniformly colored surface and including a pair of pockets disposed in partially overlapping relation for reception of the fabric, one of said pockets having an aperture, each said pocket having a front outside surface in a substantially upward facing opening with a diagonally oriented front edge wherein the openings of said pockets are in oblique facing relation to one another, the area bounded by said pockets defining a V-shaped bordered portion, wherein the fabric item is displayed within said V-shaped portion with one end fed through said aperture.

2. A display package as recited in claim 1 further including a decorative sheet material item inserted behind said item of fabric so as to have a V-shaped bordered portion displayed by said package.

3. A display package comprising, a fabric item, printed on both sides, having the approximate size of a lady's scarf, a sheet-material item having the approximate size of a greeting card for reinforcing the fabric item, and a rectangular folder having a pair of pockets disposed in partially overlapping relation for simultaneous reception of the sheet-material item and fabric item, one of said pockets having an aperture, each said pocket having a front outside surface and a substantially upward facing opening with a diagonally oriented front edge, said openings being in oblique facing relation to one another, the area bounded by said pockets being substantially smaller than the surface area of said reinforcing panel and defining a V-shaped bordered portion wherein the fabric item is displayed within said V-shaped portion, with one end of said item of fabric being fed through said aperture, said sheet-material item being placed behind said fabric item.

* * * * *